US005211190A

United States Patent [19]

Johnson et al.

[11] Patent Number: 5,211,190

[45] Date of Patent: May 18, 1993

[54] WASH ARM ATTACHMENT

[75] Inventors: Thomas M. Johnson; Lawrence J. Jordan, both of Newton, Iowa

[73] Assignee: Maytag Corporation, Newton, Iowa

[21] Appl. No.: 804,774

[22] Filed: Dec. 9, 1991

[51] Int. Cl.[5] ..... A47L 15/22

[52] U.S. Cl. ..... 134/180; 239/261; 285/38; 285/921

[58] Field of Search ..... 134/176, 177, 179, 180, 134/181; 239/261; 285/38, 123, 319, 921

[56] References Cited

U.S. PATENT DOCUMENTS

| | | | |
|---|---|---|---|
| 2,013,387 | 8/1930 | Johnston | 134/179 X |
| 2,704,083 | 10/1951 | Low | 134/183 |
| 3,370,869 | 2/1968 | Dutcher | 134/176 X |
| 3,809,106 | 5/1974 | Crabtree | 134/176 |
| 3,866,837 | 2/1975 | Jenkins | 134/176 X |
| 3,876,148 | 4/1975 | Cushing et al. | 134/179 X |
| 3,941,139 | 3/1975 | Spiegel | 134/176 |
| 3,951,684 | 4/1976 | LaPrad | 134/144 |
| 4,014,467 | 3/1977 | Ferguson | 239/261 |
| 4,172,463 | 10/1979 | Woolley | 134/176 |
| 4,443,028 | 4/1984 | Hayes | 285/38 |
| 4,869,428 | 9/1989 | Gombar | 239/261 |

FOREIGN PATENT DOCUMENTS

| | | | |
|---|---|---|---|
| 2730611 | 8/1978 | Fed. Rep. of Germany | 285/921 |

*Primary Examiner*—Philip R. Coe

*Attorney, Agent, or Firm*—Zarley, McKee, Thomte, Voorhees & Sease

[57] ABSTRACT

A wash arm attachment includes a conduit connector having a threaded end extending through a central opening in the top wall of the dishwasher tub. An upper coupling member is threaded over the threaded end of the connector member and includes a shank portion which extends downwardly into a central opening of a wash arm so that the shank portion is enclosed within an internal spray chamber of the wash arm. A retainer stud has a plurality of cantilevered spring arms which are inserted into a tapered sleeve within the lower end of the upper coupling member so as to retain the two together and so as to permit the rotatable mounting of the spray arm within the dishwasher.

15 Claims, 3 Drawing Sheets

FIG.5

WASH ARM ATTACHMENT

BACKGROUND OF THE INVENTION

This invention relates to a wash arm attachment.

Typical dishwashers include a washing fluid supply conduit which extends into the dishwasher tub for supplying a spray arm or wash arm located within the tub. The wash arm within the tub is usually horizontally mounted for rotation about a vertical axis located at its longitudinal center. The wash arm includes a hollow spray chamber therein, into which is introduced a pressurized washing fluid which then is sprayed out through numerous spray openings along the length of the wash arm.

Various means have been utilized in the prior art for attaching the wash arm within the washing chamber of the dishwasher tub so that the wash arm can receive pressurized washing fluid and so that the wash arm can rotate about a vertical axis at its longitudinal center. Many of these prior art devices require the use of screws, rivets, or other fastening means for securing the wash arm within the dishwasher tub.

One problem which sometimes occurs with the rotating wash arm within the dishwasher tub is that the pivotal axis of the wash arm sometimes becomes slightly misaligned so that the wash arm comes in contact with the walls of the dishwasher tub thereby interfering with the rotational movement of the wash arm.

SUMMARY OF THE INVENTION

Therefore, a primary object of the present invention is the provision of an improved wash arm attachment.

A further object of the present invention is the provision of an improved wash arm attachment which permits rotation of the wash arm, but also permits a selfaligning capability of the wash arm during rotation so that the wash arm will not become misaligned and inadvertently contact the walls of the dishwasher tub.

A further object of the present invention is the provision of an improved wash arm attachment which does not require the use of screws or rivets, but which instead utilizes a snap together assembly.

A further object of the present invention is the provision of an improved wash arm attachment which not only mounts the wash arm for rotation within the tub, but also permits the introduction of pressurized washing fluid from outside the tub into the spray cavity within the wash arm.

A further object of the present invention is the provision of an improved wash arm attachment which is efficient in operation, durable in use, and economical to manufacture.

The present invention achieves the foregoing objectives by providing a top wash arm supply conduit which extends from a pump located below the tub, up a sidewall and across the top of the tub to a centrally located inlet opening in the tub. A connector is connected to the conduit and includes a threaded portion which passes through the inlet opening at the top of the tub. The threaded portion of the connector is threaded into the top of a first coupling member located within the tub. The first coupling member includes a shank portion extending downwardly into a central opening in the wash arm and protruding within the spray cavity within the wash arm. The shank portion of the first coupling member includes a feed chamber for receiving washing fluid from the conduit, and the feed chamber includes a plurality of feed openings which permit the pressurized washing fluid to pass from the feed chamber into the spray cavity within the wash arm.

A second coupling member in the form of a stud having a shank portion and a head portion is utilized to rotatably secure the wash arm to the first coupling member. The shank portion of the second coupling member or stud is inserted upwardly through an opening in the bottom wall of the wash arm and protrudes within the spray cavity of the wash arm where it engages and is snapped into retentive engagement with the shank portion of the first coupling member. The snap together connection is achieved by virtue of a plurality of spring legs or arms on the stud which have locking heads at the distal ends thereof. The locking heads pass through a sleeve on the shank portion of the first coupling member and engage the upper circular edge of that sleeve to retentively hold the first and second coupling members together with the spray arm located therebetween. The spray arm then rotates about the shank portion of the first coupling member and the shank portion of the stud.

In some dishwashers, the tub walls are formed of plastic and are more flexible than porcelain, enamel, or stainless steel. Because of this tub wall flexibility, a rigid supply conduit can sometimes cause unwanted flexing of the top wall resulting in the pivotal axis of the wash arm to be somewhat misaligned from a vertical direction. This skewed posture of the rotational axis of the wash arm can result in interference of the wash arm with the top wall of the tub and possibly prevent the wash arm from rotating.

To prevent this phenomena, the bore of the sleeve portion of the first coupling member is tapered so that the stud which is within the sleeve can swing to a vertical position thereby allowing the wash arm to be horizontal. This results in a selfaligning capability of the wash arm so that it will not interfere with the top wall of the dishwasher tub, even if there is some misaligning or distortion of the top wall.

DETAILED DESCRIPTION OF THE PREFERRED EMBODIMENT

Figure 1:
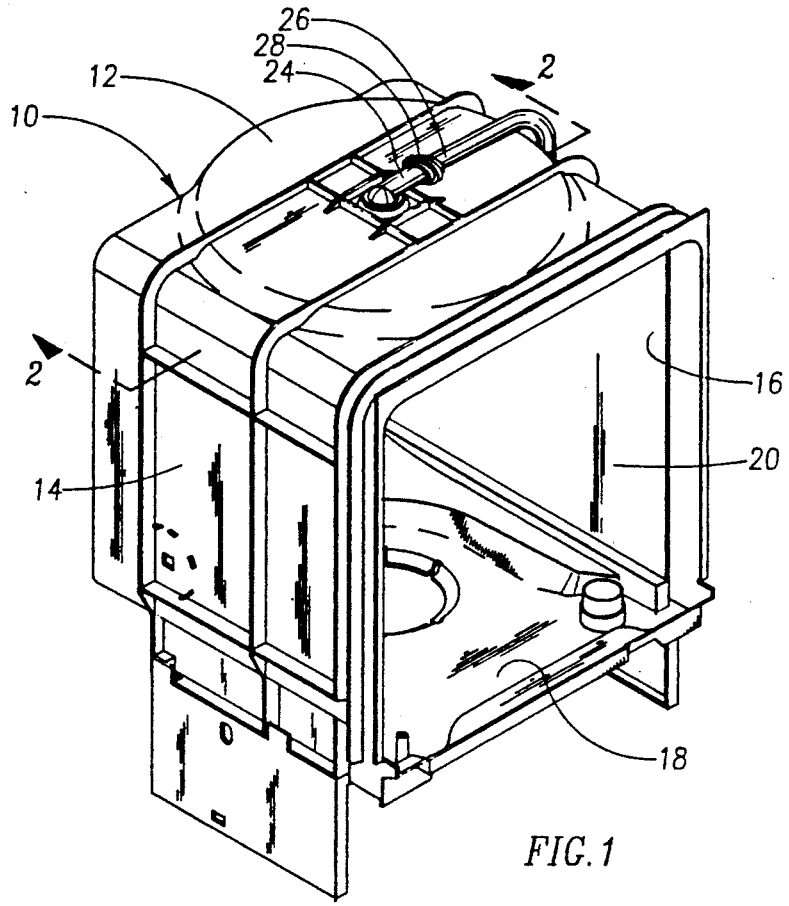
FIG. 1 is perspective view of a dishwasher tub utilizing the wash arm attachment of the present invention.

Referring to the drawings, the numeral 10 generally designates a dishwasher tub utilizing the wash arm attachment of the present invention. Tub 10 includes a top wall 12, sidewalls 14, 16, and bottom wall 18, forming a washing chamber 20 therein. Top wall 12 includes a centrally located conduit opening 22 (FIGS. 2, 3 and 4) which is adapted to receive a conduit connector 24. Conduit connector 24 is connected to a conduit 26 by means of a conduit coupling 28. The conduit 26 is adapted to be connected to a pump (not shown) for introducing pressurized washing fluid to the conduit 26 and the conduit connector 24.

Connector 24 includes a connector bore 30 which extends therethrough. A connector flange 32 is adapted to fit tightly against the margins of conduit opening 22 with a sealing gasket 64 positioned therebetween. Connector 24 also includes a threaded inner end 34 having a discharge opening 36 forming the end of connector bore 30.

A wash arm 38 is mounted within the chamber 20 and includes an upper wall 40 and a lower wall 42 which are interconnected in spaced relationship so as to form a spray chamber 44 therebetween. Extending along bottom wall 42 of wash arm 38 are a plurality of spray openings (not shown) which permit pressurized washing fluid within the spray chamber 44 to be sprayed outwardly onto the dishes within tub 20. The top wall 40 of wash arm 38 includes a circular upper flange 46 which surrounds a circular upper opening 48 providing communication into the spray chamber 44 of the wash arm 38. The lower wall 42 of wash arm 38 includes a circular lower flange 50 surrounding a circular lower opening 52 which is substantially smaller in diameter than the circular upper opening 48.

Interposed between wash arm 38 and the threaded inner end 34 of connector 24 is an upper coupling member 54. Upper coupling member 54 is adapted to be connected to a lower coupling stud 56 in the manner described below.

Figure 2:
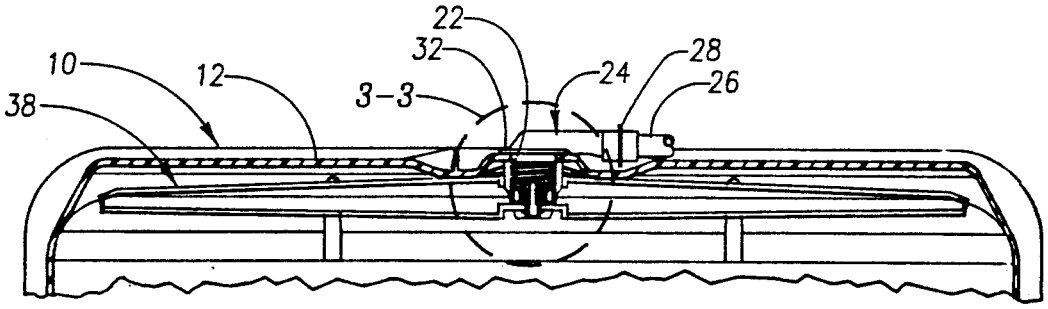
FIG. 2 is an enlarged partial sectional view of the top of the dishwasher tub showing the wash arm rotatably mounted therein.
Figure 3:
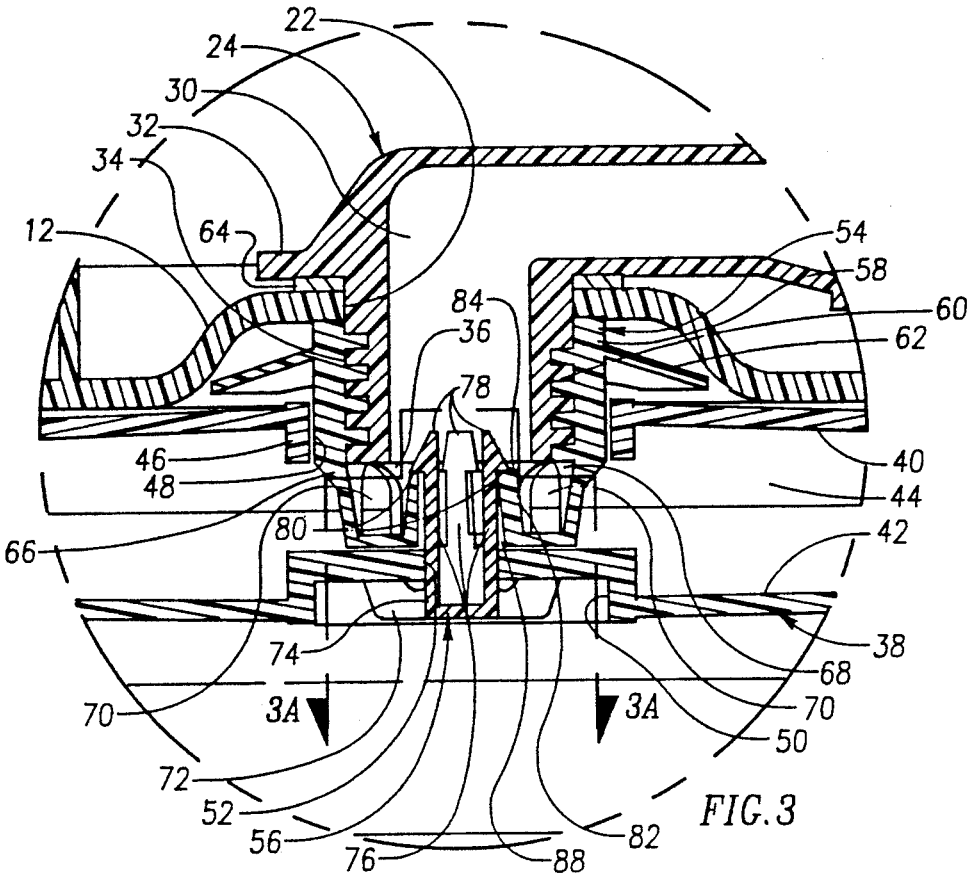
FIG. 3 is a an enlarged detail view taken along line 3—3 of FIG. 2.
Figures 4, 5:
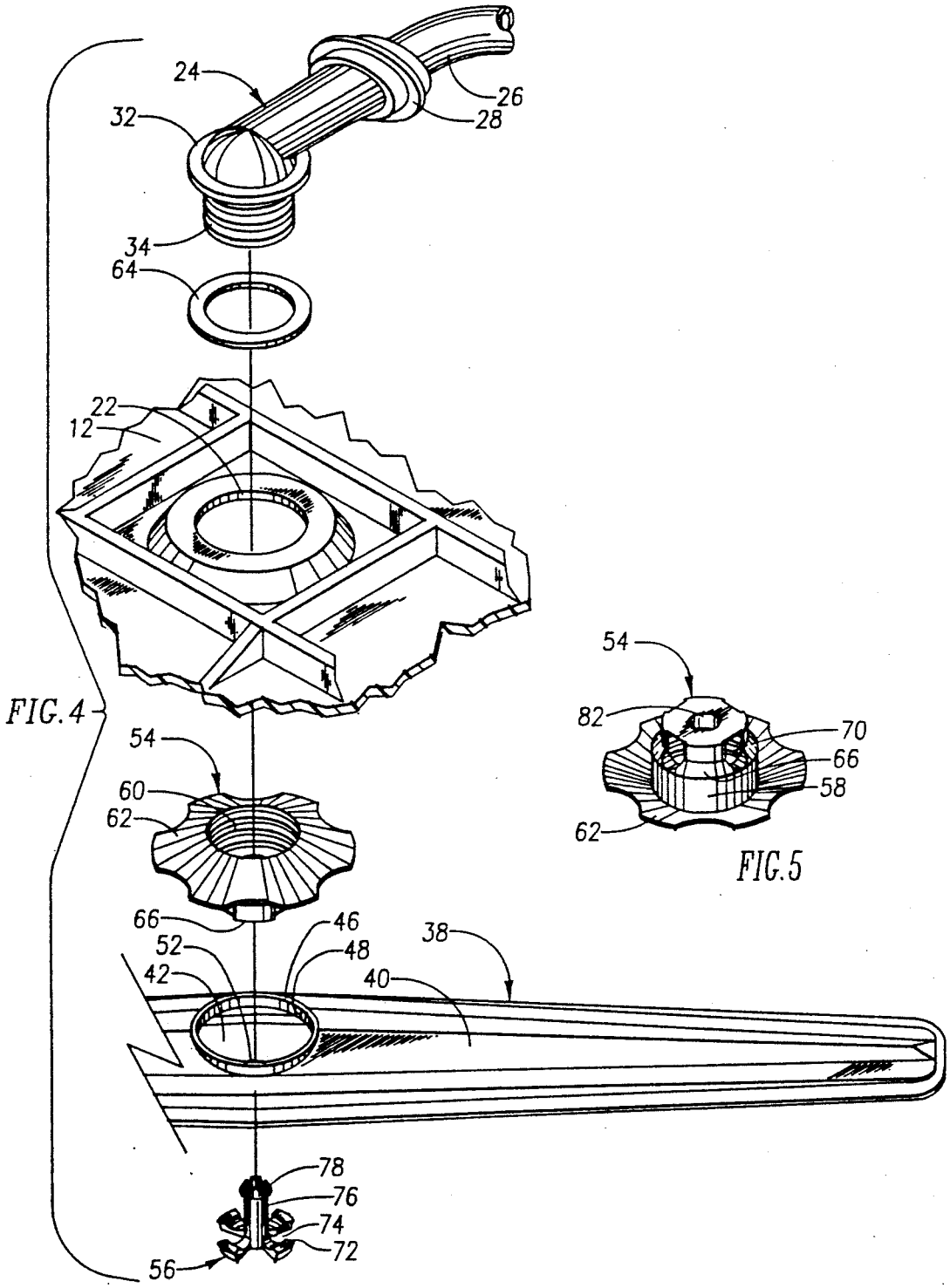
FIG. 4 is an exploded perspective view showing the various components of the wash arm attachment of the present invention.
FIG. 5 is a perspective view of the upper coupling member of the present invention showing the upper coupling member in an inverted orientation.

Coupling member 54 includes an upper portion 58 having a threaded throat 60 extending downwardly therein for threadably receiving the threaded inner end 34 of connector 24. A flange 62 is connected to the upper portion 58 so as to permit manual grasping of the upper coupling member 54 for rotation so that the upper coupling member 54 can be threaded onto the threaded inner end 34 of coupling member 24 as shown in FIGS. 2 and 3. Upper coupling member 54 also includes a shank portion 66 which houses a feed chamber 68 therein. A plurality of feed openings 70 are provided in the shank portion 66 to permit washing fluid communication from the feed chamber 68 outwardly into the spray chamber 44 of wash arm 38 as can be seen in FIG. 3. In the position shown in FIG. 3, it can be seen that the shank portion 66 of the upper coupling member 54 protrudes downwardly through the circular upper opening 48 of wash arm 38 and is enclosed within the spray chamber 44. This permits pressurized washing fluid to pass through the connector bore 30 of connector 24 into the feed chamber 68 of shank portion 66 of upper coupling member 54, and thence through the feed openings 70 of the shank portion 66 into the spray chamber 44.

Figure 3A:
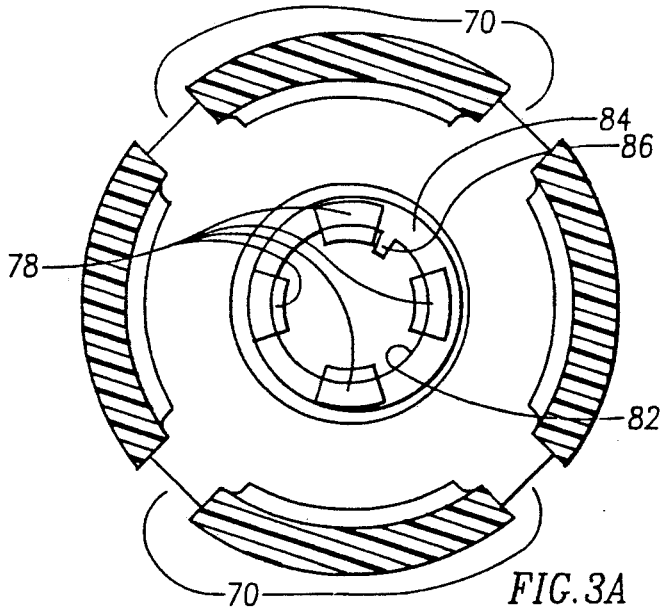
FIG. 3A is a sectional view taken along line 3A—3A of FIG. 3.

The wash arm 38 is mounted to the upper coupling member 54 by means of lower coupling stud 56. Stud 56 includes a stud head 72 and a stud shank 74 which is comprised of four spring fingers 76. At each of the distal ends of the four spring fingers 76 is a locking head 78 having a downwardly presented locking shoulder 80 thereon. The stud shank 74 is telescopically received within a tapered sleeve 82 which is formed in the lower end of shank portion 66 of the upper coupling member 54. The locking shoulders 80 of the four spring fingers 76 engage the upwardly presented edge 84 of the sleeve 82 so as to lock the lower stud member 56 to the upper coupling member 54. The stud head 72 engages the bottom wall 42 of the wash arm 38 so as to limit downward movement thereof. At the same time, the upper and lower circular openings 48, 52 of the wash arm 38 are free to rotate about the shank portion 66 of upper coupling member 54 and the shank 74 of the lower coupling stud 56. The lower coupling stud 56 is held against rotation with respect to the upper coupling member 54 by means of a key rib 86 (FIG. 3A) which engages the four spring fingers 76 thereby preventing rotation therebetween.

The assembly of the wash arm 38 into the dishwasher tub 10 is as follows: First, the threaded lower end 34 of conduit connector 24 is inserted into the conduit opening 22. Next, the threaded throat 60 of the upper coupling member 54 is threaded over the threaded inner end 34 of the conduit connector 24 thereby securing the two tightly together with the gasket 64 sealing around the conduit opening 22 as shown in FIG. 3. Next, the upper circular opening 48 of the wash arm 38 is fitted over the shank portion 66 of the upper coupling member 54. Finally, the four spring fingers 76 of the lower coupling stud 56 are inserted into the open lower end 88 of the tapered sleeve 82. The locking heads 78 at the distal ends of the four spring fingers 76 are adapted to cam radially inwardly so that the four spring fingers 76 are moved radially inwardly as they pass through the tapered sleeve 82. When the four locking heads 78 exit through the upper end of the sleeve 82, the spring fingers 76 spring outwardly thereby causing the locking shoulders 80 to engage the upper edge 84 of the sleeve 82 so that the lower coupling stud 56 is locked to the upper coupling member 54.

The tapered configuration of the sleeve 82 permits a slight tilting of the lower coupling stud 56. This is an important feature inasmuch as it permits the wash arm 38 to self-align in the event that the wash arm encounters or touches the top wall 12 of the dishwasher tub during rotation. If such touching is encountered, the wash arm will tilt by virtue of the inner action between the stud 56 and the tapered sleeve 82 thereby permitting the wash arm to continue to rotate and to self-align.

The washing fluid is introduced into the connector bore 30 and then into the feed chamber 68 of the upper coupling member 54. From the feed chamber 68, the pressurized washing fluid passes through feed openings 70 into the spray chamber 44 of the wash arm 38, thereby permitting the fluid to be sprayed downwardly through the spray openings (not shown) in the bottom wall of the wash arm 38.

The device can also be easily disassembled for replacement of the wash arm 38 merely by grasping the flanges 62 of the upper coupling member 54 and unthreading the upper coupling member 54 from the threaded inner end 34 of conduit connector 24. When these two parts are disassembled, the wash arm 38 can be removed from the dishwasher tub and replaced. Furthermore, the upper coupling member 54 can be detached from the lower coupling stud 56 by forcing the spring fingers 76 radially inwardly and pulling the stud 56 outwardly from tapered sleeve 82. Thus, it is a simple matter to disassemble and remove the wash arm 38 from the dishwasher.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. In combination:

a dishwasher tub having tub walls enclosing a washing chamber;

a wash arm having a longitudinal axis, first and second opposite ends, and spaced apart upper and lower walls defining a spray chamber therebetween, an upper circular opening being in said upper wall and a lower circular opening being in said lower wall and registered below said upper circular opening;

a first coupling member having an upper portion above said upper wall of said wash arm and having a shank portion extending downwardly through said upper circular opening into said spray chamber;

a second coupling member having a head portion below said bottom wall of said wash arm and having a shank portion extending upwardly through said lower circular opening into said spray chamber and retentively engaging said shank portion of said first coupling member, whereby said wash arm is free to rotate about said shank portions of said first and second coupling members;

means attaching said upper portion of said first coupling member to said dishwasher tub within said washing chamber whereby said wash arm, said first coupling member and said second coupling member are within said washing chamber.

2. A combination according to claim 1 wherein said first coupling member includes a hollow feed chamber therein, said feed chamber having an open upper end adapted to be connected to a pressurized source of washing fluid and at least one feed opening providing fluid communication from said feed chamber to said spray chamber of said wash arm.

3. A combination according to claim 2 wherein said attaching means comprise conduit means mounted within said dishwasher tub and connected to a source of pressurized washing fluid, said conduit means having a discharge end connected to said open upper end of said feed chamber for delivering said pressurized fluid to said feed chamber.

4. A combination according to claim 3 wherein said conduit means fixedly attaches said first coupling member to said tub and holds said first coupling member against rotation, said wash arm being rotatable about said shank portion of said first coupling member.

5. A combination according to claim 1 wherein said shank portion of said second coupling member is connected to said shank portion of said first coupling member in such a manner as to prevent rotational movement between said first and second coupling members.

6. A combination according to claim 1 wherein said head portion of said second coupling member engages said bottom wall of said wash arm and supports said wash arm against downward movement, said wash arm being supported with its said longitudinal axis in approximately a horizontal plane.

7. A combination according to claim 6 wherein said shank portion of said first coupling member includes a first lock means and said shank portion of said second coupling member includes a second lock means detachably connected to said first lock means, said shank portion of said second coupling member having an approximately vertical axis when connected to said shank portion of said first coupling member, said first and second lock means cooperating to permit limited tilting movement of said approximately vertical axis of said second coupling member about a horizontal tilt axis located adjacent said first and second lock means.

8. A combination according to claim 7 wherein one of said first and second lock means comprises a sleeve having a hollow bore extending therethrough and the other of said first and second lock means comprises an elongated stud telescopically received within said hollow bore of said sleeve.

9. A combination according to claim 8 wherein said hollow bore of said sleeve is tapered, said stud being approximately cylindrical in shape so as to be capable of limited tilting movement of its cylindrical axis while telescopically received within said bore.

10. A combination according to claim 9 wherein said stud includes a first locking surface facing in a first direction and said sleeve includes a second locking surface facing in a second direction opposite from said first direction, said first and second surfaces being in facing engagement to connect said first and second coupling members together.

11. A combination according to claim 1 wherein said shank portion of said first coupling member includes a first lock means and said shank portion of said second coupling member includes a second lock means connected to said first lock means, one of said first and second lock means having a first locking shoulder and the other of said first and second locking means having a spring finger with a second locking shoulder thereon, said first and second locking shoulders retentively engaging one another to connect said first and second connecting members together.

12. A combination according to claim 11 wherein said spring finger is yieldably movable from a lock position wherein said first and second locking shoulders retentively engage one another to an unlock position wherein said first and second locking shoulders are out of retentive engagement with one another to permit disconnection of said first and second coupling members from one another.

13. A combination according to claim 1 wherein one of said shank portions of said first and second coupling members includes a sleeve having a sleeve bore and the other of said first and second shank portions includes a stud received within said sleeve bore, said stud and said sleeve having first and second catch members respectively, engaging one another to prevent removal of said stud from said sleeve bore.

14. A combination according to claim 13 wherein said first catch member is yieldably movably connected to said stud for yieldable movement from a normal position retentively engaging said second catch member of said sleeve to prevent removal of said stud from said sleeve bore to a release position out of retentive engagement with said second catch member to permit insertion and removal of said stud from said sleeve bore.

15. A combination according to claim 14 wherein said first catch member includes a cam surface for engaging the inner surface of said sleeve bore and for causing said first catch member to move to said release position during insertion of said stud into said sleeve bore.

* * * * *